US005664741A

United States Patent [19]

Duke

[11] Patent Number: 5,664,741

[45] Date of Patent: Sep. 9, 1997

[54] NUTATED BEAMRIDER GUIDANCE USING LASER DESIGNATORS

[75] Inventor: Jimmy R. Duke, Huntsville, Ala.

[73] Assignee: The United States of America as represented by the Secretary of the Army, Washington, D.C.

[21] Appl. No.: 636,780

[22] Filed: Apr. 19, 1996

[51] Int. Cl.[6] ..... F41G 7/20

[52] U.S. Cl. ..... 244/3.11

[58] Field of Search ..... 244/3.13, 3.11

[56] References Cited

U.S. PATENT DOCUMENTS

| | | | |
|---|---|---|---|
| 3,782,667 | 1/1974 | Miller, Jr. et al. | 244/3.13 |
| 4,006,356 | 2/1977 | Johnson et al. | 244/3.16 |
| 4,034,949 | 7/1977 | Hoesterey et al. | 244/3.16 |
| 4,038,547 | 7/1977 | Hoesterey | 250/338 |
| 4,111,385 | 9/1978 | Allen | 244/3.13 |
| 4,143,835 | 3/1979 | Jennings, Jr. et al. | 244/3.11 |
| 4,179,085 | 12/1979 | Miller, Jr. | 244/3.13 |
| 4,773,754 | 9/1988 | Eisele | 356/152 |
| 5,226,614 | 7/1993 | Carlson | 244/3.13 |
| 5,259,568 | 11/1993 | Amon et al. | 244/3.13 |
| 5,344,099 | 9/1994 | Pittman et al. | 244/3.13 |
| 5,374,009 | 12/1994 | Miller, Jr. et al. | 244/3.3 |
| 5,410,398 | 4/1995 | Appert et al. | 244/3.13 |

FOREIGN PATENT DOCUMENTS

| | | | |
|---|---|---|---|
| 2033186 | 5/1980 | United Kingdom | 244/3.13 |
| WO93/01465 | 1/1993 | WIPO | 244/3.13 |

*Primary Examiner*—Michael J. Carone
*Assistant Examiner*—Christopher K. Montgomery
*Attorney, Agent, or Firm*—Hugh P. Nicholson; Freddie M. Bush; Hay Kyung Chang

[57] ABSTRACT

The Nutated Beamrider Guidance Using Laser Designators provides a means of producing an accurate laser beamrider command guidance link between the launch platform and the missile during its flight through the addition of a simple variable offset nutator mechanism to existing Army laser designators. Such a beamrider guidance enables the missile to determine its position in the guidance field by measuring the angle of arrival of side scatter from the pulsed beam. These measurements result in the production of correctional signals which cause the missile to move closer to the boresight axis for eventual impact on the target.

5 Claims, 6 Drawing Sheets

FORWARD VIEW

NUTATED BEAMRIDER GUIDANCE USING LASER DESIGNATORS

DEDICATORY CLAUSE

The invention described herein may be manufactured, used and licensed by or for the Government for governmental purposes without the payment to me of any royalties thereon.

BACKGROUND OF THE INVENTION

Systematic research in semi-active laser (SAL) guidance for missiles began nearly 30 years ago with the advent of the high power Ruby and Nd YAG pulsed lasers. In this form of missile guidance, the target is first sighted and thereafter tracked by a sighting device such as a TV camera. A fixed beam laser designator that is boresighted to the camera designates the target by directing laser energy pulses to be incident on it. The laser energy reflects and scatters off of the target and this reflected energy is detected by the missile's terminal homing seeker which is tuned to the frequency of the laser pulses. The seeker then locks onto the target-reflected laser energy and flies by terminal homing guidance to the site of the energy reflection for eventual impact on the target. Such a guidance system is disclosed in U.S. Pat. No. 4,143,835 (Mar. 13, 1979).

In another form of missile guidance, beamrider command guidance, the gunner transmits an encoded laser beam around a path to the target, the path being defined by the boresighted sighting device. A spatially modulated guidance field is created around the path and into this field is launched the missile. One or more aft-looking receivers on the missile measures the missile's position in the field relative to the boresight axis and causes the missile to guide itself to the boresight axis for a more accurate impact on the target. The receiver looks directly back into the laser beam, thereby allowing a low power laser to be used and reducing the susceptibility to optical countermeasures. Such a system is disclosed in U.S. Pat. No. 3,782,667 (Jan. 1, 1974) in which the further capability of nutation spatial modulation allows error signals to be measured on the missile proportional to its position from the boresight axis, resulting in a high degree of guidance accuracy. However, the beamrider teachings of U.S. Pat. No. 3,782,667 cannot be practiced with any of the currently existing semi-active laser designators used in fielded systems due to the lack of hardware commonality between the SAL designators and the beamrider beam projector hardware.

Some work has been performed lately to achieve a form of laser beamrider command guidance using the extant laser designators with no change being required in the designators for maximum commonality. What resulted is a guidance system (U.S. Pat. No. 5,374,009; Dec. 20, 1994) which measures the arrival angle on the missile of scattered energy that originally emanated from the designator. The measured arrival angle of the scattered energy is used to determine the missile's direction from the beam. But in this system, the receiver on the missile cannot measure the distance of the missile from the beam so that, although the proper direction of missile flight correction can be determined, the magnitude of the correction cannot be calculated with accuracy. With the teachings of U.S. Pat. No. 5,374,009, the correction magnitude can be varied only in response to the duration of an error's polarity. The resulting level of accuracy is, at best, coarse compared to proportional guidance.

SUMMARY OF THE INVENTION

The Nutated Beamrider Guidance Using Laser Designators (henceforth, the nutated beamrider) teaches a means of producing an accurate laser beamrider command guidance link between the launch station and the flying missile by the addition of a simple variable offset nutator mechanism to existing Army laser designators. This form of beamrider guidance enables the missile to determine its position in the guidance field with a proportional error signal by measuring the angle of arrival, on the missile, of the nutated pulsed beam after the beam has been side-scattered by the atmospheric particles.

DESCRIPTION OF THE PREFERRED EMBODIMENT

Figure 3:
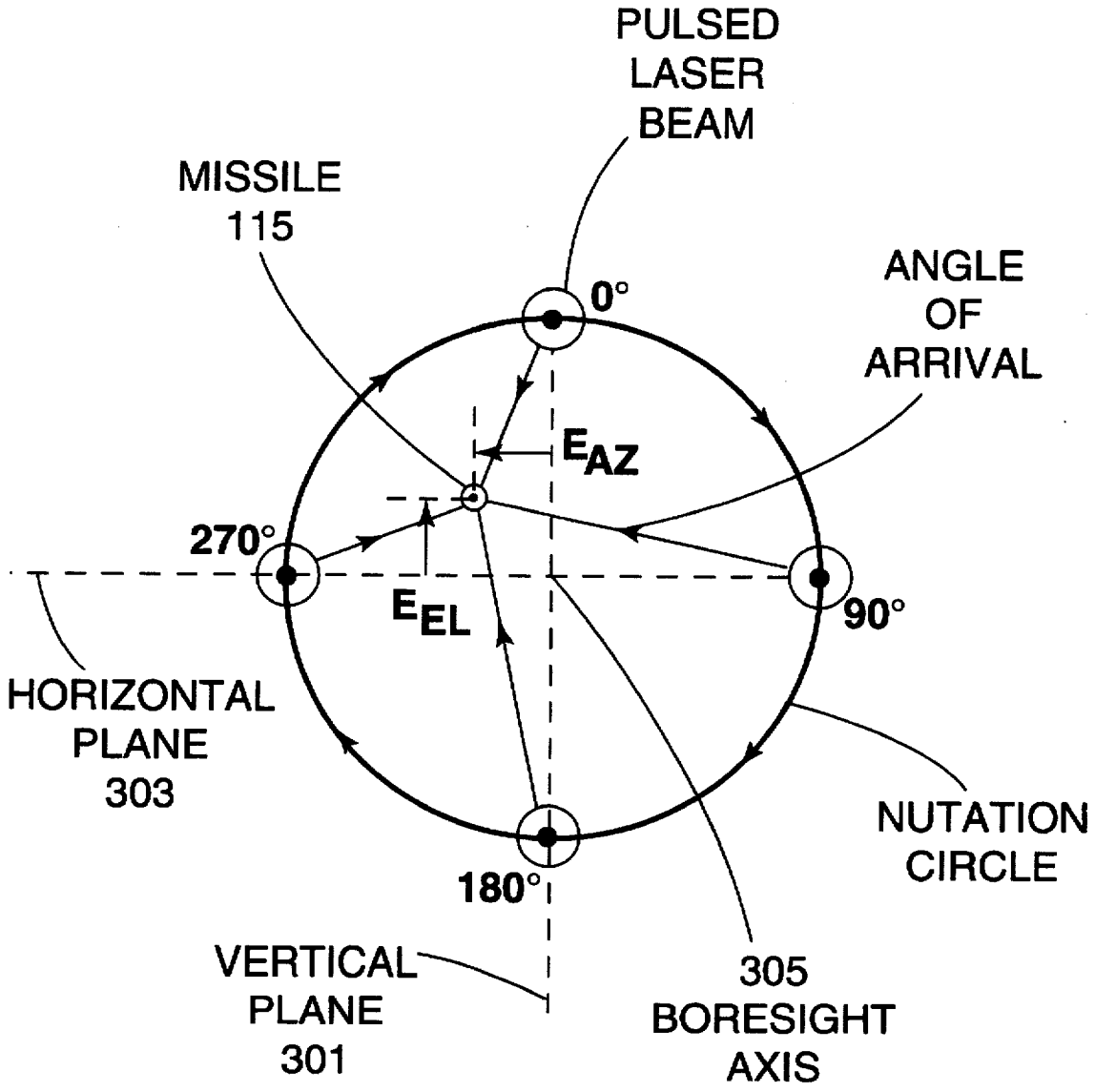
FIG. 3 illustrates the geometry associated with the position error measurement on the missile.

By the addition of a simple nutator mechanism to future laser designators or as a retrofit to extant semi-active laser designators, the nutated beamrider extends the capability of existing laser designators that are being used in fielded systems such as the Target Acquisition and Designation Sight/Pilots Night Vision Sensor (TADS/PNVS) on the Apache helicopter and that are being planned for use in future systems. The addition of the nutated beamrider renders the laser designator to have dual capabilities: one, to be used in its conventional designator mode for laser semi-active terminal homing guidance when the missile launched requires terminal homing guidance and two, with the nutator mechanism switched on, to be used as a beam projector in laser beamrider command guidance mode when the launched missile accepts such beamrider guidance. The nutated beamrider, whose accuracy approaches that of proportional error guidance, enables the missile to guide itself by means of side-looking receivers, canted aft, as illustrated in FIG. 3, to sense the direction-of-arrival of energy from the nutated pulsed laser beam after being scattered to the side by atmospheric scattering phenomena. The beamrider guidance capability makes it possible, with a designator, either to guide a missile along a path in space independent of a sighted target until the target comes within the missile seeker field-of-view for lock-on or to guide a missile to target impact with the attendant advantages of beamrider guidance. The former capability of the dual mode is critical to enabling extended range, mid-course guidance for future, lock-on-after-launch missile systems with terminal homing accuracy now under development consideration. In the latter of the dual mode, the missile effective range is typically limited by the platform stabilization and pointing accuracy.

With reference now to the drawing wherein like numbers represent like parts in each of the several figures and the arrows indicate the direction of optical travel, the structure and operation of the nutated beamrider is explained.

Figure 1:
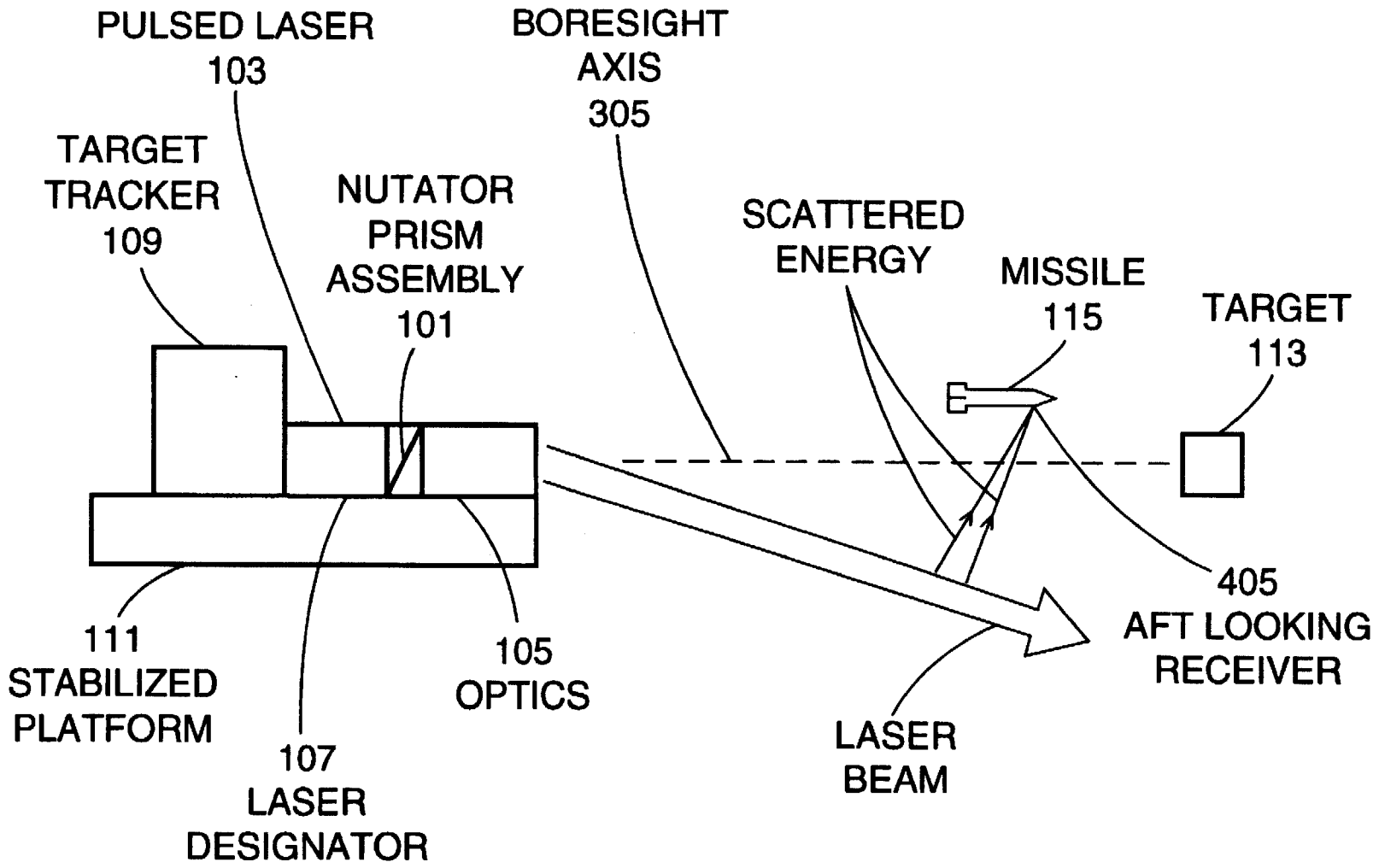
FIG. 1 shows how the nutator prism assembly added to the laser designator performs the beamrider guidance functions.

As shown in FIG. 1, nutator 101 (which is comprised of a prism assembly as is further explained later) is sandwiched between pulsed laser 103 and beam-forming optics 105 of typical laser designator 107. In addition, the laser designator has suitable target tracker 109 such as FLIR or TV and the entire designator is mounted on stabilized platform 111 of a helicopter (not shown here).

In the conventional semi-active laser designator mode, (i.e. the nutator mechanism is inactivated and reverted to its conventional boresight alignment function), target 113 is sighted and tracked via tracker 109 while laser beam emanating from pulsed laser 103 is transmitted by beam-forming optics 105 to be incident on the target. The beam illuminates and is reflected by the target and the semi-active terminal homing seeker of missile 115 seeks the reflected illumination for eventual impact on the target. This is the principle used to advantage in the U.S. Pat. No. 4,143,835.

The nutator beamrider mode, as taught by applicant, is engaged when nutator 101 is activated and laser beamrider missile 115 is launched along a path in the general direction of the target at a range beyond the lock-on range of the missile seeker. The path to the target is defined by target tracker 109 which is boresighted to the designator. The seeker of the missile is controlled to remain pointed along this path during flight so that lock-on of the target can be accomplished when the target signature becomes sufficient to enable the terminal homing guidance. The laser pulses emanating from laser 103 are synchronized to predetermined nutator angles so as to produce a nutated proportional error guidance field that results in accurate measurement of missile position and consequent accurate guidance, as is further explained hereinbelow.

Figure 2:
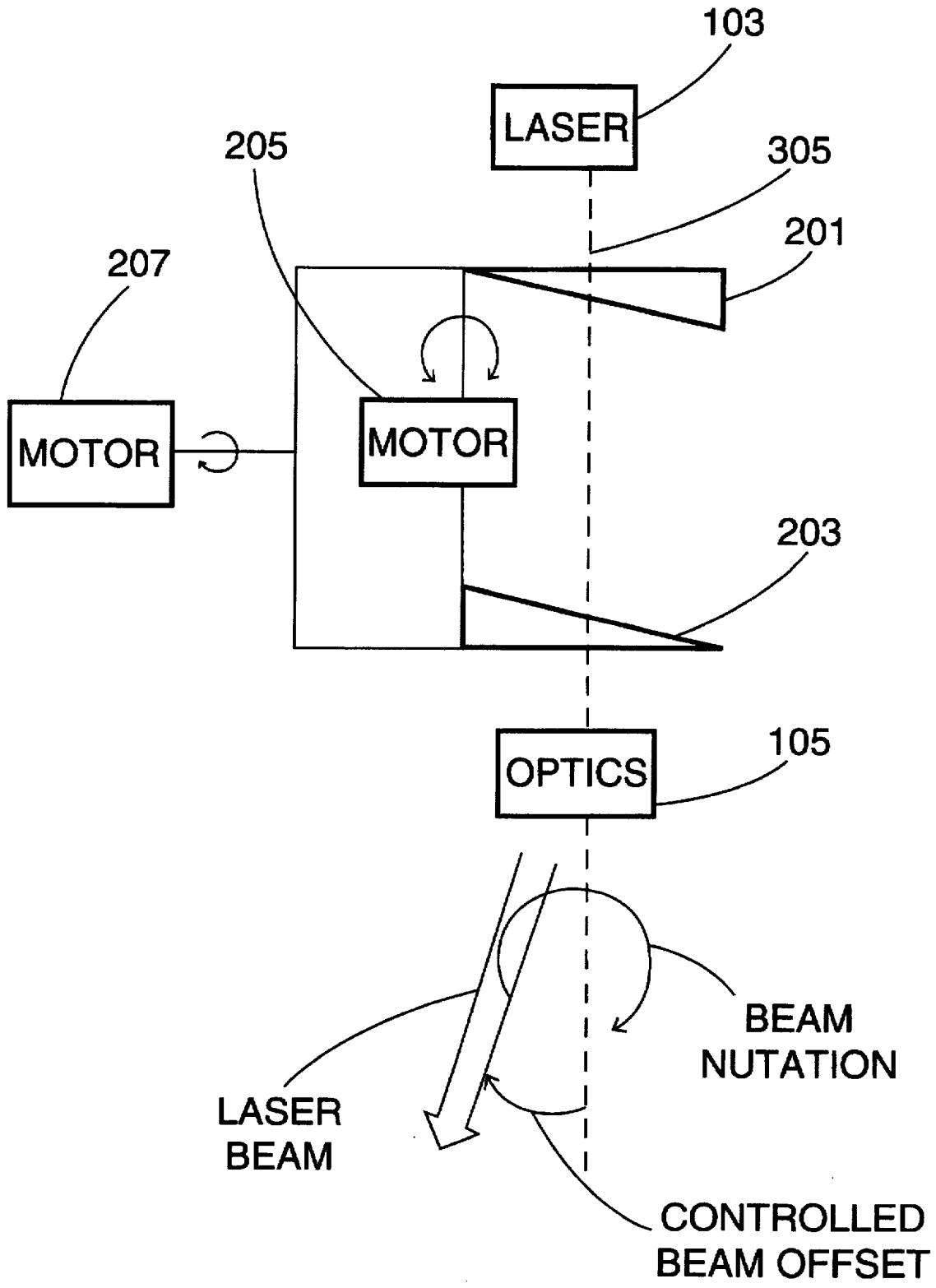
FIG. 2 illustrates how the nutator prism assembly controls the beam offset angle.

As is illustrated in detail in FIG. 2, first and second prisms, 201 and 203, respectively, comprise nutator prism assembly 101. By counter-rotating, the prisms control the beam offset angle, the bigger offset between the prisms causing the greater angle between the beam path and the boresight axis. More specifically, the beam offset angle is controlled by first motor 205 which is coupled to rotate first prism 201 at variable angles relative to second prism 203 while second motor 207, coupled to both prisms 201 and 203, rotates both prisms simultaneously to produce beam nutation. When in the conventional semi-active laser designator mode, this variable counter-rotation angle and thus beam offset angle is set to zero, returning the beam to the boresight axis. In the beamrider guidance mode, the prisms are simultaneously rotated at a rate equal to ¼ of the pulse repetition rate of the laser to produce the nutation circle. In order to maintain this nutation circle at a near constant diameter, for example several meters, around the missile at any given point in time during its flight toward the target, the prisms are pre-programmed with predicted missile range as a function of time. The near-constant diameter at the missile simplifies position error calculations performed at the missile.

Missile guidance data rates of up to one half of the pulse repetition rate of laser designator 107 are possible. In the current designator technology, this is 20 pulses per second which would allow up to a 10 hertz data rate in each axis for guidance. Such rate is adequate for the low acceleration rates associated with the mid-course guidance of stable missiles for long range targets.

Figure 4:
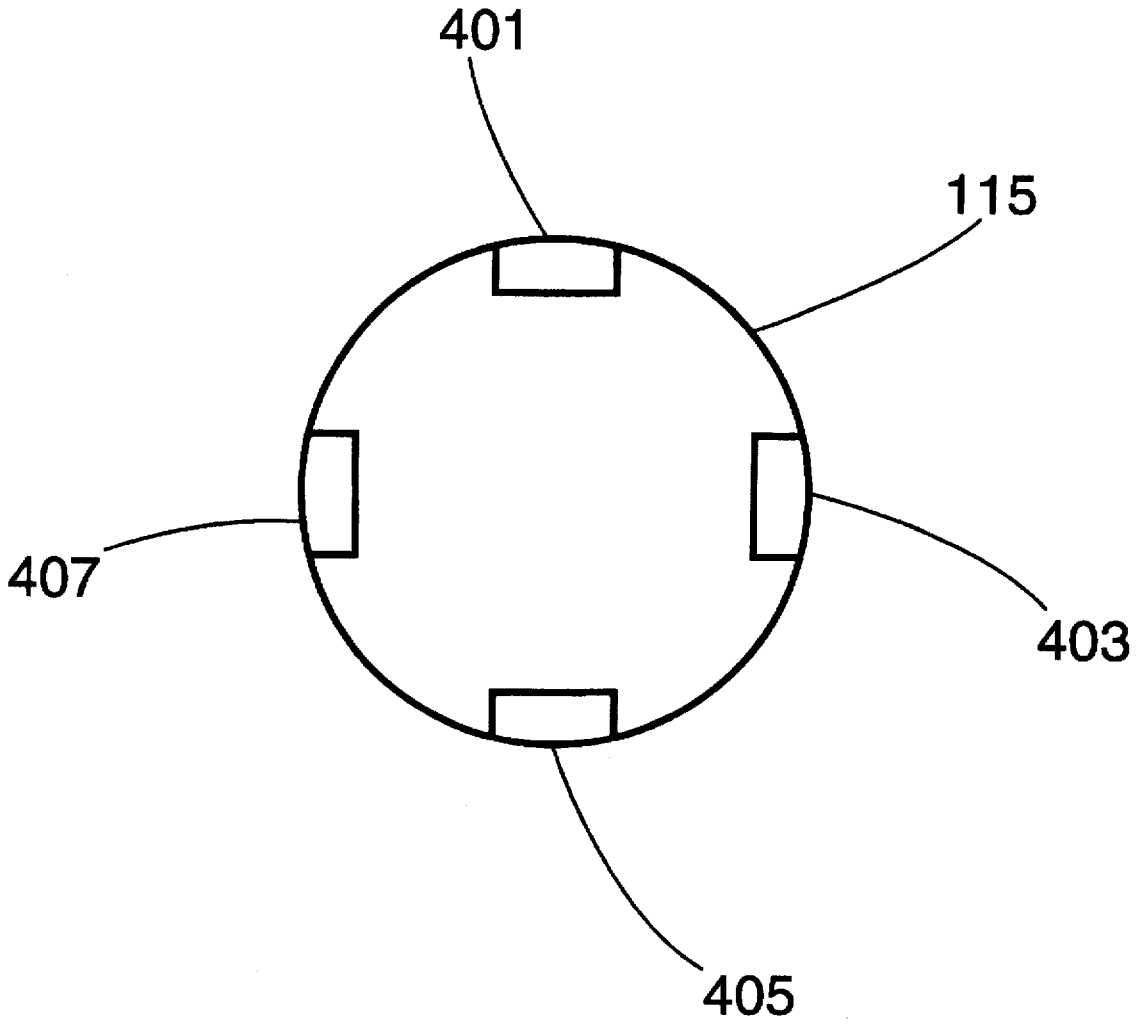
FIG. 4 shows the location of light-receivers on the missile.

FIG. 3 shows the geometry associated with the position error measurement on the missile that results in the production of information regarding the missile's position with respect to boresight axis 305 to target 113. The pulses emanating from laser 103 are synchronized to nutator angle to fire at 0, 90, 180 and 270 degrees, respectively. Light-receivers 401, 403, 405 and 407 each located in a separate quadrant of the missile body, as shown in FIG. 4, sense the angles of arrival of side-scatter energy from each laser pulse. Two angles measured by receivers 401 and 405 from vertical plane 301 and another two measured by receivers 403 and 407 from horizontal plane 303 yield one completely independent x-y position error measurement. However, to increase data rate, error measurements may be calculated following each laser pulse by processing it with the previous pulse from the opposite side of the missile. Error measurements thusly calculated are indicative of the actual position of the missile in the beamrider guidance field and can be referred to as the positional information. The positional information is, then, input to the guidance computer, not shown, residing in the missile to be used to generate suitable guidance commands. The guidance commands, in turn, are input to the control mechanism, also not shown, of the missile to guide the missile closer to the boresight axis for a more direct impact on target 113 or to carry the missile to the window in space where the missile's terminal homing guidance can take over for the terminal phase to intercept.

Figure 5:
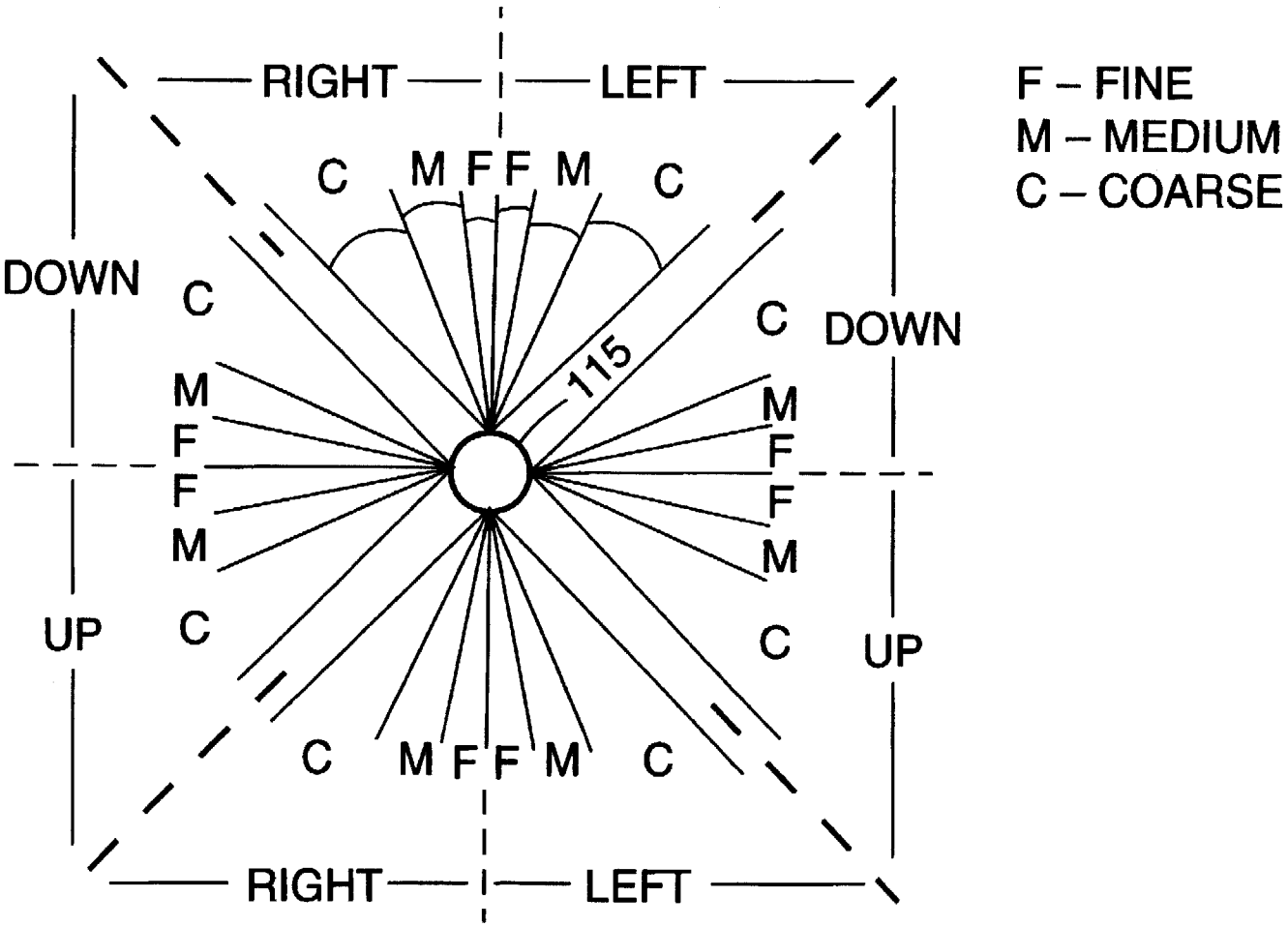
FIG. 5 illustrates the receiver optical field-of-view geometry on the missile.
Figure 6:
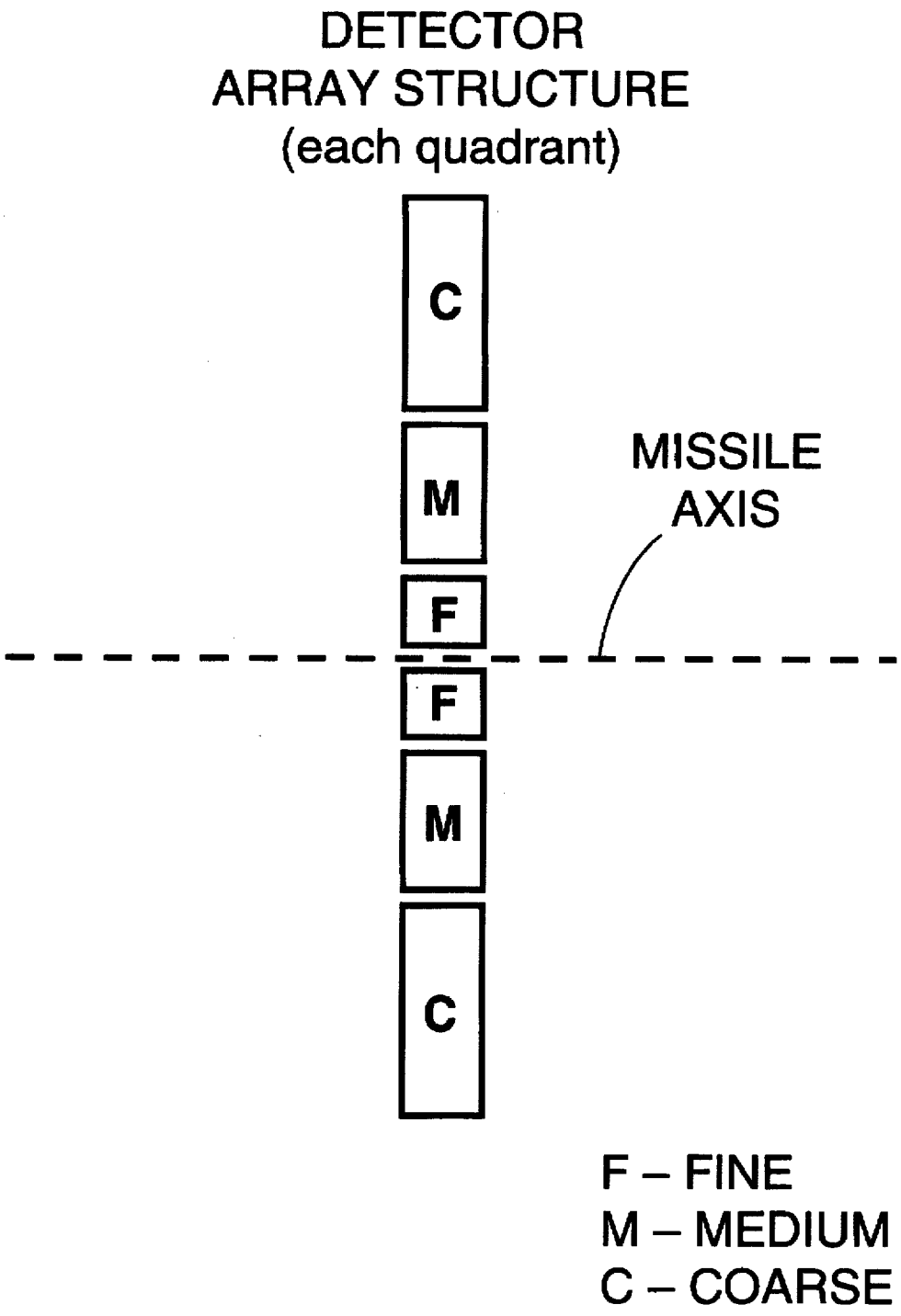
FIG. 6 illustrates the arrangement and variety of the detector elements.

FIG. 5 shows the receiver optical field-of-view geometry on the missile. Each of the four optical receivers may be a graded resolution field-of-view detector array to provide fine resolution measurements for accuracy when the missile is near boresight axis 305 and lower resolution coarse angular measurements when further off-axis. Each array is comprised of 6 detector elements, arranged in a linear fashion as illustrated in FIG. 6, two outer coarse-resolution elements circumscribing two medium-resolution elements which, in turn, circumscribe two inner fine-resolution elements. The greatest resolution is achieved by attempting to balance the energy between the two fine-resolution elements of each quadrant. Low cost, uncooled silicon detector array technology can be used at the short wavelength of the Nd YAG laser.

As a result of the 360 degree coverage of the optical receivers around the circumference of the missile, the guidance field extends out beyond the nutation circle, limited in distance only by the ability to detect the scatter energy. The region outside the nutation circle is useful for coarse guidance during missile capture or during large deviations to return it to the more accurate guidance circle.

Although a particular embodiment and form of this invention has been illustrated, it is apparent that various modifications and embodiments of the invention may be made by those skilled in the art without departing from the scope and spirit of the foregoing disclosure. Accordingly, the scope of the invention should be limited only by the claims appended hereto.

I claim:

1. In a semi-active laser designator having a means for tracking a target, a laser for emitting light pulses and beam-forming optics for forming beams from the pulses and sending the beams in the general direction of the target; a system for providing laser beamrider guidance to a missile in its flight toward the target, the missile having therein capabilities to generate correctional signals from missile positional information and change flight direction in response to the correctional signals for a more accurate impact on the target, said system utilizing atmospheric particles and comprising:

A nutator comprising a first prism and a second prism, said prisms being adapted for counter-rotation; a first motor coupled for rotating said first prism at variable angles relative to said second prism to achieve variation in the beam offset angle and a second motor coupled in parallel to said first and second prisms to rotate said prisms simultaneously to produce the nutation in the beam, said nutator being positioned between the laser and the beam-forming optics of the designator such that the light pulses emitted by the laser pass through said nutator and are nutated thereby prior to reaching the optics, the emission of the light pulses being synchronized with pre-determined nutator angles; and a plurality of light receivers, said receivers being mounted on the missile for receiving the nutated light as the nutated light scatters from atmospheric particles and producing from the received nutated light missile positional information.

2. A system for providing laser beamrider guidance to a missile as set forth in claim 1, wherein said prism assembly is pre-programmed with predicted missile range as a function of missile flight time so as to maintain a nutation circle of near constant diameter around the missile at any point in time during the missile's flight.

3. A system for providing laser beamrider guidance as set forth in claim 2, wherein said light receivers are located along the circumference of the missile, at least one receiver in each quadrant.

4. A system for providing laser beamrider guidance as set forth in claim 3, wherein each of said receivers is a graded resolution field-of-view detector array having at least six detector elements.

5. A system for providing laser beamrider guidance as set forth in claim 4, wherein said detector elements comprise two each of coarse, medium and fine, respectively, resolution, said six elements being arranged in a linear fashion such that said two fine-resolution elements are at the center and are circumscribed by said medium-resolution elements, said medium-resolution elements being, in turn, circumscribed by said coarse-resolution elements.

* * * * *